US010465469B2

(12) United States Patent
Sanchez

(10) Patent No.: US 10,465,469 B2
(45) Date of Patent: Nov. 5, 2019

(54) SLIP-ON HYDRAULIC PACKER

(71) Applicant: Baker Hughes, a GE company, LLC, Houston, TX (US)

(72) Inventor: James Scott Sanchez, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 68 days.

(21) Appl. No.: 15/714,240

(22) Filed: Sep. 25, 2017

(65) Prior Publication Data

US 2019/0093449 A1 Mar. 28, 2019

(51) Int. Cl.
*E21B 33/128* (2006.01)

(52) U.S. Cl.
CPC ..... *E21B 33/1285* (2013.01)

(58) Field of Classification Search
CPC ..... E21B 33/12; E21B 33/1285; E21B 23/06
See application file for complete search history.

(56) References Cited

U.S. PATENT DOCUMENTS 3,316,969 A * 5/1967 Smith ..... E21B 33/127 166/187
6,612,372 B1 * 9/2003 Freiheit ..... E21B 33/1208 166/147
2004/0007366 A1 * 1/2004 McKee ..... E21B 33/1216 166/387
2014/0332239 A1 * 11/2014 Porta ..... E21B 33/1285 166/387
2015/0041148 A1 * 2/2015 Greenan ..... E21B 34/102 166/374
2016/0194938 A1 * 7/2016 Fripp ..... E21B 33/1285 166/244.1

* cited by examiner

*Primary Examiner* — David J Bagnell
*Assistant Examiner* — Brandon M Duck
(74) *Attorney, Agent, or Firm* — Parsons Behle & Latimer

(57) ABSTRACT

A slip-on hydraulic packer system and method. The packer system includes a tubular, a packer assembly that includes a piston moveable within a cylinder, a sealing element connected to the piston, and a biasing member connected between a stop member and the piston. Retaining elements selectively connect the packer system to an exterior surface of the tubular. A predetermined amount of hydraulic pressure may be applied to move the piston moving the sealing element from an unset position to a set position. The retaining elements may be snap rings and/or set screws that engage a profile on the tubular. Hydraulic pressure may be applied from an interior of the tubular through a port in the tubular or from an exterior of the tubular through a port in the cylinder. The predetermined amount of hydraulic pressure may shear an element or burst a member before moving the piston.

26 Claims, 3 Drawing Sheets

SLIP-ON HYDRAULIC PACKER

FIELD OF THE DISCLOSURE

The embodiments described herein relate to a slip-on hydraulic packer for downhole tubulars and methods of using the same.

BACKGROUND

Description of the Related Art

There are many applications in well drilling, servicing, and completion in which it becomes necessary to isolate particular zones within the well. For example, an annular packer or seal may be necessary to seal off on annulus between a tubing string and the casing, larger tubing, or the wellbore. The specific size, length, and configuration of the packer needed may vary depending on the application. Thus, a well owner and/or service provider may need to have a large inventory of annular packers on hand in order be able to meet the needs of various applications requiring an annular seal. Conventional annular packers or sealing seals are typically manufactured with a body or casing connected to a tubular that may be connected along a tubing string. The conventional annular packers and/or sealing systems may be complex and thus, may be expensive. Further, the application on a particular wellbore may need to be temporarily halted if the needed packer is not available on site requiring it to be ordered or even manufactured. Any downtime waiting for a requisite packer system may be costly. As the length of conventional packers is not variable, it may be necessary to use pup joints to provide proper spacing along a tubing string when inserting a conventional packer.

Other disadvantages may exist.

SUMMARY

The present disclosure is directed to a slip-on hydraulic packer for downhole tubulars and methods of use that overcome some of the problems and disadvantages discussed above.

One embodiment of the present disclosure is a packer system comprising a tubular and a packer assembly comprising a piston selectively movable within a cylinder, a sealing element having a first end connected to an end of the piston and a second end, and a biasing member connected between a stop member and the piston. The packer system comprises a first retaining element that selectively connects the packer assembly to an exterior of the tubular and a second retaining element that selectively connects the packer assembly to the exterior of the tubular. A predetermined hydraulic pressure applied to the packer assembly moves the piston within the cylinder towards the stop member to move the sealing element from an unset position to a set position.

The packer system may include a backup member connected between the second end of the piston and the biasing member. The predetermined hydraulic pressure may be applied to the cylinder from an interior of the tubular through a port in the tubular. The piston may be selectively connected to the cylinder by at least one shearable element and the at least one shearable element may be configured to shear and release the piston from the cylinder upon the application of the predetermined hydraulic pressure. The packer system may include a burstable member positioned within the port of the tubular to selectively close the port in the tubular. The burstable member may be configured to burst upon the application of the predetermined hydraulic pressure to permit the predetermined hydraulic pressure to be applied to the piston positioned within the cylinder.

At least one of the first retaining element or the second retaining element may comprises a snap ring positioned within a profile on the exterior of the tubular. At least one of the first retaining element or the second retaining element may comprises a set screw that engages a profile on the exterior of the tubular. The predetermined hydraulic pressure may be applied to the cylinder from the exterior of the tubular through a portion in the cylinder. The piston may be selectively connected to the cylinder by at least one shearable element, which may be configured to shear and release the piston from the cylinder upon the application of the predetermined hydraulic pressure through the port in the cylinder. The packer system may include a burstable member positioned within the port in the cylinder to selectively close the port in the cylinder. The burstable member may be configured to burst upon the application of the predetermined hydraulic pressure to permit the predetermined hydraulic pressure to be applied to the piston within the cylinder through the port in the cylinder.

One embodiment of the present disclosure is a method of providing a slip-on hydraulic packer. The method comprises providing a seal assembly that comprises a piston selectively movable within a cylinder, an end of the piston being connected to a first end of a sealing element, a second end of the sealing element being connected to a biasing member connected to a stop member. The method comprises connecting the seal assembly to an exterior of a tubular with a first retaining element and connecting the seal assembly to the exterior of the tubular with a second retaining element.

The method may include providing a first profile on the exterior of the tubular and providing a second profile on the exterior of the tubular, wherein the first retaining element engages the first profile and wherein the second retaining element engages the second profile. The method may comprise connecting a portion of the piston to a portion of the cylinder via a shearable member configured to shear under a predetermined amount of hydraulic pressure. The method may include providing a port through the tubular, wherein hydraulic pressure from an interior of the tubular may be applied to the piston within the cylinder through the port in the tubular. The method may include providing a burstable element within the port through the tubular, the burstable element may be configured to burst under a predetermined amount of hydraulic pressure, wherein the burstable element prevents fluid flow through the port in the tubular until the burstable element bursts. The method may comprise pumping fluid down a tubing string to the interior of the tubular so that hydraulic pressure from the interior of the tubular moves the piston towards the stop member, the movement of the piston moving the sealing element from an unset position to a set position.

The method may comprising providing a port through the cylinder, wherein hydraulic pressure from the exterior of the tubular may be applied to the piston within the cylinder through the port in the cylinder. The method may include pumping fluid down an annulus between a tubing string and a wellbore so that hydraulic pressure from the annulus moves the piston towards the stop member, the movement of the piston moving the sealing element from an unset position to a set position. The method may include providing a burstable element within the port through the cylinder. The burstable element may be configured to burst under a predetermined amount of hydraulic pressure, wherein the burstable element prevents fluid flow through the port until the burstable element bursts.

One embodiment of the present disclosure is a slip-on hydraulic packer kit comprising a piston positioned within a cylinder, wherein the piston is movable within the piston upon the application of a predetermined amount of hydraulic pressure within the cylinder. The slip-on hydraulic packer kit comprises a sealing element having a first end and a second end, the first end being connected to an end of the piston and a backup member connected to the second end of the sealing element. The slip-on hydraulic packer kit comprises a stop member and a biasing member connected between the backup member and the stop member. The slip-on hydraulic packer kit comprises a first retaining member and a second retaining member, wherein the first and second retaining members are configured to selectively connect the slip-on hydraulic packer kit to a tubular and wherein the application of the predetermined amount of hydraulic pressure within the cylinder moves the piston towards the stop member to move the sealing element from an unset position to a set position The predetermined amount of hydraulic pressure may be applied to the cylinder from an interior of the tubular through a port in the tubular. The predetermined amount of hydraulic pressure may be applied to the cylinder from an exterior of the tubular through a port in the cylinder. The slip-on hydraulic packer kit may comprise at least one of a shearable member configured to shear upon application of the predetermined amount of hydraulic pressure or a burstable member configured to burst upon application of the predetermined amount of hydraulic pressure.

One embodiment of the present disclosure is a method of treating a borehole. The method comprises attaching to a tubular a hydraulically actuated packer system having one or more retaining elements for selectively connecting the packer system to an exterior surface of the tubular, the packer system comprising a piston selectively moveable within a cylinder, a sealing element having a firs tend connected to an end of the piston and a second end connected to a backup member, and a biasing member connected between a stop member and the backup member. The method comprises applying a predetermined hydraulic pressure to the piston within the cylinder to move the sealing element from an unset position to a set positioned by advancing the piston towards the stop member, wherein a first zone of the borehole is isolated from a second zone. The method may comprise treating a well treatment in the first or second zones of the borehole. The well treatment may comprise hydraulic fracturing, stimulation, tracer injection, acidizing, steam injection, water flooding, and/or cementing.

Figure 1:
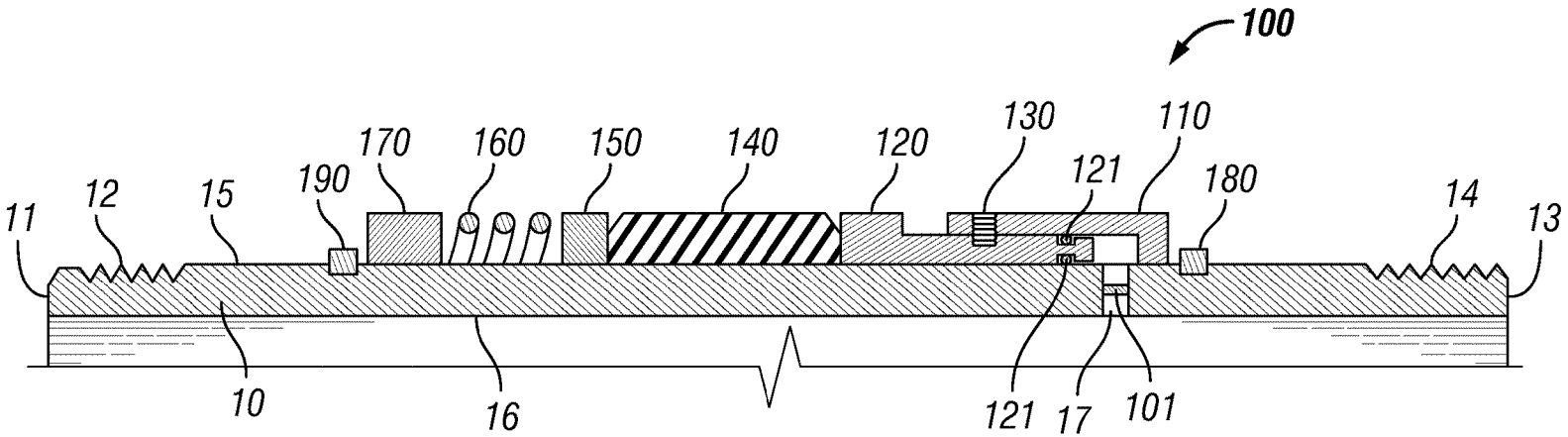
FIG. 1 shows an embodiment of a slip-on hydraulic packer with the sealing element in an unset position.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an embodiment of a slip-on hydraulic packer assembly 100 that has been installed onto an exterior 15 of a tubular 10 on site and/or in the field. The tubular 10 may be various tubulars used in the production of hydrocarbons as would be appreciated by one of ordinary skill in the art having the benefit of this disclosure. The tubular 10 may be customized and may be same tubular that is being used along a tubing string. The hydraulic packer assembly 100, also referred to herein as a seal assembly, may be connected to a tubular 10 in the field and/or on site. Thus, the hydraulic packer assembly 100 may be installed on a tubular with a specified length, which may eliminate the need to use pup joints to properly space out the packer assembly 100 along the tubing string.

The packer assembly 100 includes a piston 120 positioned within a cylinder 110. The packer assembly 100 may include a seal (not shown) positioned between the cylinder 110 and the exterior 15 of the tubular 10 as would be appreciated by one of ordinary skill in the art having the benefit of this disclosure. The piston 120 may be selectively movable within the cylinder 110. For example, hydraulic pressure may be applied to the piston 120 within the cylinder 110 via a port 17 within the tubular 10 that extends from the inner surface 16 of the tubular 10 to the outer surface of the tubular 15 as discussed herein.

The packer assembly 100 may be installed onto the exterior 15 of a ported tubular 10. The ported tubular 10 may include a sleeve (not shown) on the interior 16 of the tubular 10 that selectively permits hydraulic pressure within the interior 16 of the tubular 10 to be applied to the piston 120 within the cylinder 110 as would be appreciated by one of ordinary skill in the art having the benefit of this disclosure. In one embodiment a port 17 may drilled or otherwise made in the tubular 10 as would be appreciated by one of ordinary skill in the art having the benefit of this disclosure. A first end 11 of the tubular 10 may include threads 12 and the second end 13 of the tubular 10 may include threads 14 to permit the tubular 10 along with the packer assembly 100 to be installed along a tubing string within a wellbore as would be appreciated by one of ordinary skill in the art having the benefit of this disclosure.

One end of the piston 120 is connected to or positioned adjacent to a sealing element or packer 140. FIG. 1 shows the sealing element 140 in an unset or initial position. The packer assembly 100 includes a backup element 150 connected to or positioned adjacent to the end of the sealing element 140 opposite the piston 120. The assembly 100 includes a biasing member 160, such as a spring, that is positioned between the backup member 150 and a stop member 170. The biasing member 160 biases the backup member 150, seal 140, and the piston 120 in an initial position, shown in FIG. 1, in which the seal 140 is in an unset position.

The packer assembly 100 may be connected to various sizes of tubulars 10 on site as would be appreciated by one of ordinary skill in the art having the benefit of this disclosure. The packer assembly 100 is selectively connected to the exterior 15 of the tubular 10 via a first retaining element 180 and a second retaining element 190. The first and second retaining elements 180, 190 may be various mechanisms that may be used to selectively connect the packer assembly 100 to the exterior 15 of the tubular 10 depending on the application as would be appreciated by one of ordinary skill in the art having the benefit of this disclosure. For example, the first and second retaining elements 180, 190 may comprise snap rings that each engage a profile, such as a groove, on the exterior 15 of the tubular 10. The first retaining element 180 may engage a first profile and the second retaining element 190 may engage a second profile that are positioned such that the packer assembly 100 may be selectively retained on the exterior 15 of the tubular 10. As another example, the first and second retaining elements 180, 190 may comprise bodies having set screws that may be used to selectively retain the packer assembly 100 to the exterior 15 of the tubular 10. The use of the first and second retaining element 180, 190 permits the installation of the packer assembly 100 onto a tubular 10

The piston 120 may be selectively moved within the cylinder 110 upon the application of a predetermined amount of pressure through the port 17 of the tubular 10. Various mechanisms may be used to prevent selectively prevent the movement of the piston 120 until desired. For example, a sleeve (not shown) may be located on the interior 106 of the tubular 10 that would prevent the application of hydraulic pressure onto the piston 120 until the port 17 was opened by the movement of the sleeve.

As another example, a portion of the piston 120 may be connected to the cylinder 110 via a shearable device 130, such as a shear screw, that is adapted to shear upon the application of a predetermined amount of pressure and thus, selectively release the piston 120 from the cylinder 110. The piston 120 may include a seal or plurality of seals 121, such as orings, to seal an interface between the piston 120 and the cylinder 110. Once the shearable device 130 has sheared to selectively release the piston 120 from the cylinder 110 due to the application of a predetermined amount of pressure, the application of pressure through the port 17 in the tubular 10 will move the piston 120 towards the stop member 170 as discussed herein.

As discussed above, the piston 120 may be selectively moved within the cylinder 110 upon the application of a predetermined amount of pressure through the port 17 of the tubular 10. For example, the port 17 in the tubular 10 may include a burstable device 101, such as a burst disc, that is configured to prevent fluid flow through the port 17 until the application of a predetermined amount of pressure at the port 17. The burstable device 101 may be configured to burst upon the application of the predetermined amount of pressure at the port 17. Once the burstable device 101 has burst, the pressure may be applied to the piston 120 within the cylinder 110 via the port 17. The packer assembly 100 of FIG. 1 is shown with both a shearable device 130 and a burstable member 101 for illustrative purposes. The packer assembly 100 may include only one device that selectively prevents the movement of the piston 120 within the cylinder 110 until the application of a predetermined amount of pressure as would be appreciated by one of ordinary skill in the art having the benefit of this disclosure. In some embodiments, the packer assembly 100 may include more than one device (e.g., a shearable device 130, a burstable member 101) that selectively prevents the movement of the piston 120 within the cylinder 110.

Figure 2:
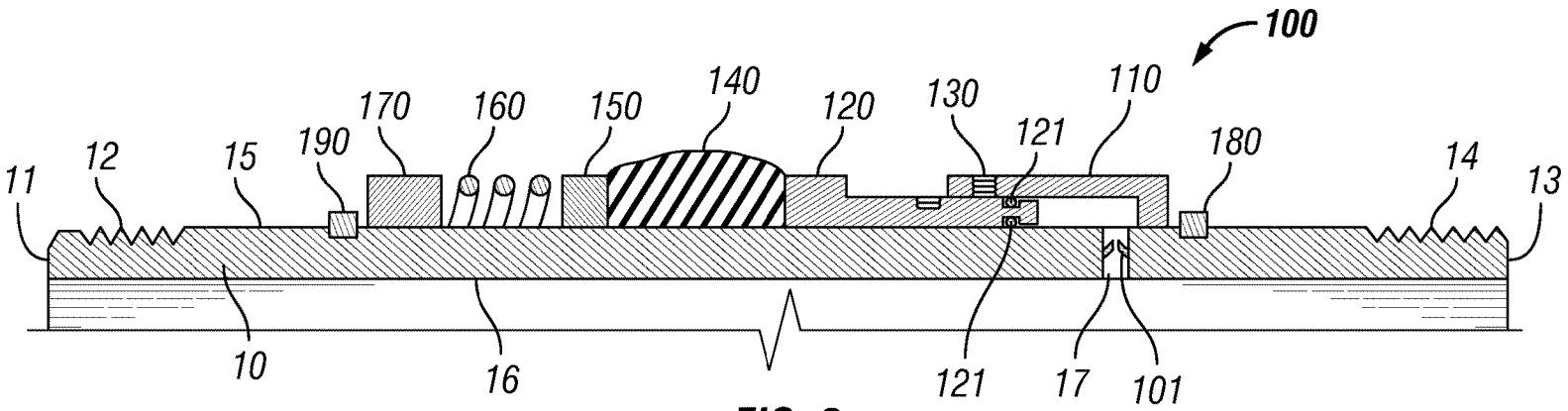
FIG. 2 shows the slip-on hydraulic packer of FIG. 1 with the sealing element in a set position.

FIG. 2 shows the seal element 140 of the packer assembly 100 in a set position. The seal element 140 in the set position may be used to create a seal between the tubular 10 and a portion of a wellbore or a tubular, such as casing or production tubing, within a wellbore as would be appreciated by one of ordinary skill in the art having the benefit of this disclosure. Hydraulic pressure has been applied to the piston 120 via port 17 to move the piston 120 towards the stop member 170. The movement of the piston 120 compresses biasing member 160 while moving the backup member 150 and the seal 140 towards the stop member 170. The stop member 170 limits the overall travel of the backup member 150. Continued application of pressure on the piston 120 will compress the sealing element 140 between the backup member 150 and the piston 120. The compression of the sealing element 140 causes the outward expansion of the sealing element 140, which may be used to create a seal between the tubular 10 and a portion of a wellbore or a portion of tubing within a wellbore as would be appreciated by one of ordinary skill in the art having the benefit of this disclosure.

The sealing element 140 may be unset from the wellbore by reducing and/or eliminating that application of hydraulic pressure on the piston 120 via the port 17 in the tubular 10. The biasing member 160 biases the backup member 150, seal element 140, and piston 120 back towards their initial positions as shown in FIG. 1. The biasing member 160 will move the backup member 150, seal element 140, and piston 120 back towards their initial positions as the force of the biasing member 160 exceeds the force applied to the piston 120 by the hydraulic pressure applied via the port 17 in the tubular 10.

The packer or seal assembly 100 of FIGS. 1 and 2 provide a packer or seal that may be constructed in the field and/or onsite. The assembly 100 may reduce the cost for providing an annular packing element for a tubing string. The assembly 100 allows for the manufacturing of an annular packer on site that may be customized to the needs of a specific application. Conventional packers or annular sealing elements must typically manufactured off site requiring a body to be connected to a tubular. As the packers need to be pre-manufactured, a service provider may need to keep a large amount of inventory on hand to ensure that a desired packing device is ready depending on the application needed. In some instances, a well service provide and/or well owner may not have the appropriate packer or annular sealing device on hand depending on the application possibly requiring the production and/or wellbore services to be suspended until an appropriate packer can be ordered and/or delivered to the wellbore. The packer assemblies of the present disclosure may be used with tubulars already on site and may reduce the amount of parts needed in inventory. Further, the packer assemblies of the present disclosure may be assembled, as need, on site reducing potential inventory as well as potentially reducing down time.

Figure 3:
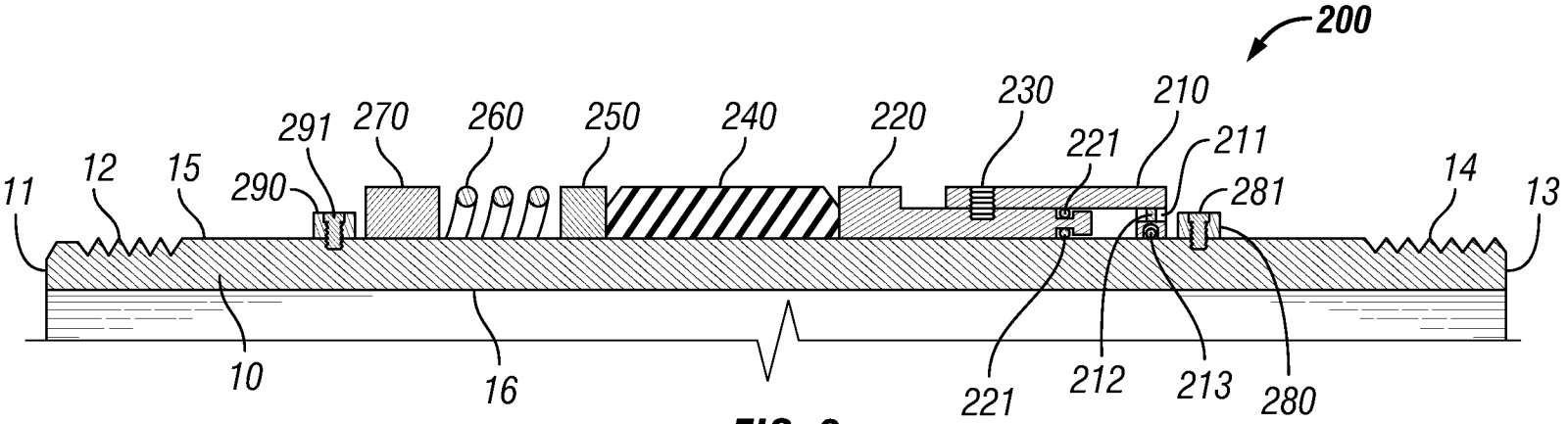
FIG. 3 shows an embodiment of a slip-on hydraulic packer with the sealing element in an unset position.

FIG. 3 shows an embodiment of a slip-on hydraulic packer or seal assembly 200 that has been installed onto an exterior 15 of a tubular 10 on site and/or in the field. The tubular 10 may be various tubulars used in the production of hydrocarbons as would be appreciated by one of ordinary skill in the art having the benefit of this disclosure. The hydraulic packer assembly 200 may be connected to a tubular 10 in the field and/or on site. The packer assembly 200 includes a piston 220 positioned within a cylinder 210. The packer assembly 200 may include a seal 213 positioned between the cylinder 210 and the exterior 15 of the tubular 10. The piston 220 may be selectively movable within the cylinder 210. For example, hydraulic pressure may be applied to the piston 220 within the cylinder 210 via a port 211 within the cylinder 210, as discussed herein. Thus, annulus pressure between a tubing string, along which the packer assembly is installed, and a portion of a wellbore may be applied to move the piston 220 within the cylinder 210, as discussed herein. A first end 11 of the tubular 10 may include threads 12 and the second end 13 of the tubular 10 may include threads 14 to permit the tubular 10 along with the packer assembly 200 to be installed along a tubing string within a wellbore as would be appreciated by one of ordinary skill in the art having the benefit of this disclosure.

One end of the piston 220 is connected to or positioned adjacent to a sealing element or packer 240. FIG. 3 shows the sealing element 240 in an unset or initial position. The packer assembly 200 includes a backup element 250 connected to or positioned adjacent to the end of the sealing element 240 opposite the piston 220. The assembly 200 includes a biasing member 260, such as a spring, that is positioned between the backup member 250 and a stop member 270. The biasing member 260 biases the backup member 250, seal 240, and the piston 220 in an initial position, shown in FIG. 3, in which the seal 240 is in an unset position.

The packer assembly 200 may be connected to various sizes of tubulars 10 on site as would be appreciated by one of ordinary skill in the art having the benefit of this disclosure. The packer assembly 120 is selectively connected to the exterior 15 of the tubular 10 via a first retaining element 280 and a second retaining element 290. The first and second retaining elements 280, 290 may be various mechanisms that may be used to selectively connect the packer assembly 200 to the exterior 15 of the tubular 10 depending on the application as would be appreciated by one of ordinary skill in the art having the benefit of this disclosure. For example, the first and second retaining elements 280, 290 includes set screws 281, 291 that maybe used to selectively connect the retaining element 280, 290 to the exterior 15 of the tubular 10. For example, the set screws 281, 291 of the retaining elements 280, 290 may be configured to engage a first profile and a second profile on the exterior 15 of the tubular 10. The first and second profiles may be positioned such that the packer assembly 200 may be selectively retained on the exterior 15 of the tubular 10. The use of the first and second retaining element 280, 290 permits the installation of the packer assembly 200 onto a tubular 10

The piston 220 may be selectively moved within the cylinder 210 upon the application of a predetermined amount of pressure through the port 211 in the cylinder 210. For example, a portion of the piston 220 may be connected to the cylinder 210 via a shearable device 230, such as a shear screw, that is adapted to shear upon the application of a predetermined amount of pressure and thus, selectively release the piston 220 from the cylinder 210. The piston 220 may include a seal or plurality of seals 221, such as orings, to seal an interface between the piston 220 and the cylinder 210. Once the shearable device 230 has sheared due to the application of a predetermined amount of pressure to selectively release the piston 220 from the cylinder 210, the application of pressure through the port 211 in the cylinder 210 will move the piston 220 towards the stop member 270, as discussed herein.

As discussed above, the piston 220 may be selectively moved within the cylinder 210 upon the application of a predetermined amount of pressure through the port 211 in the cylinder 210. For example, the port 211 in the cylinder 210 may include a burstable device 212, such as a burst disc, that is configured to prevent fluid flow through the port 211 until the application of a predetermined amount of pressure at the port 211. The burstable device 212 may be configured to burst upon the application of the predetermined amount of pressure at the port 211. Once the burstable device 212 has burst, the pressure may be applied to the piston 220 within the cylinder 210 via the port 211 in the cylinder 210. The packer assembly 200 of FIG. 3 is shown with both a shearable device 230 and a burstable member 212 for illustrative purposes. The packer assembly 200 may include only one device that selectively prevents the movement of the piston 220 within the cylinder 210 until the application of a predetermined amount of pressure as would be appreciated by one of ordinary skill in the art having the benefit of this disclosure. In some embodiments, the packer assembly 200 may include more than one device (e.g., a shearable device 230, a burstable member 212) that selectively prevents the movement of the piston 220 within the cylinder 210.

Figure 4:
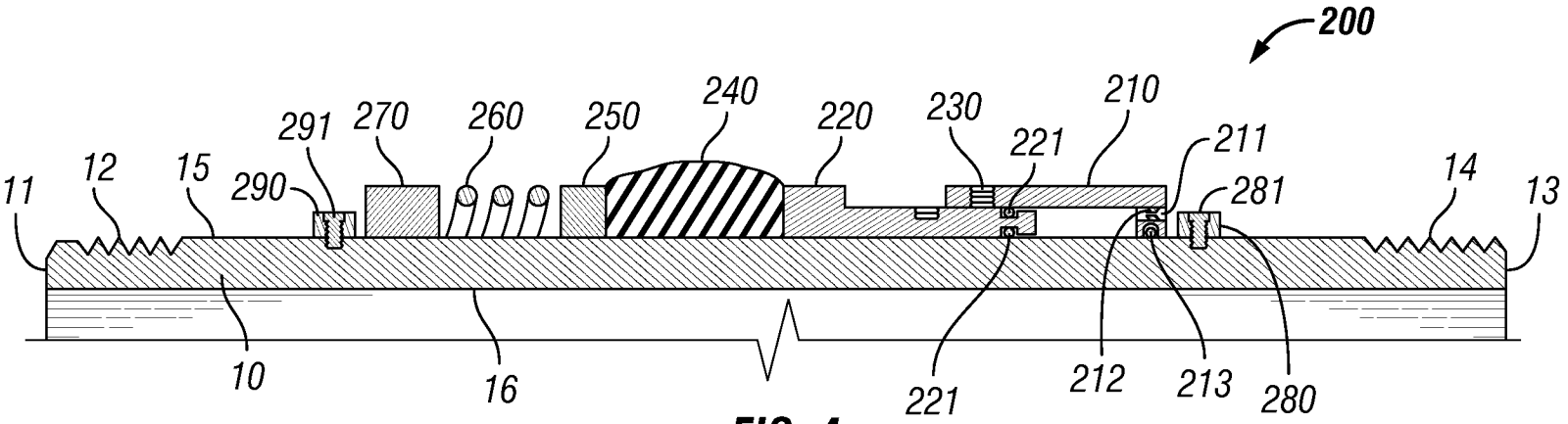
FIG. 4 shows the slip-on hydraulic packer of FIG. 3 with the sealing element in a set position.

FIG. 4 shows the seal element 240 of the packer assembly 200 in a set position. The seal element 240 in the set position may be used to create a seal between the tubular 10 and a portion of a wellbore or a tubular, such as casing or production tubing, within a wellbore as would be appreciated by one of ordinary skill in the art having the benefit of this disclosure. Hydraulic pressure has been applied to the piston 220 via port 211 to move the piston 220 towards the stop member 270. The movement of the piston 220 compresses biasing member 260 while moving the backup member 250 and the seal 240 towards the stop member 270. The stop member 270 limits the overall travel of the backup member 250. Continued application of pressure on the piston 220 will compress the sealing element 240 between the backup member 250 and the piston 220. The compression of the sealing element 240 causes the outward expansion of the sealing element 240, which may be used to create a seal between the tubular 10 and a portion of a wellbore or a portion of tubing within a wellbore as would be appreciated by one of ordinary skill in the art having the benefit of this disclosure.

The sealing element 240 may be unset from the wellbore by reducing and/or eliminating that application of hydraulic pressure on the piston 220 via the port 211 in the cylinder 210. The biasing member 260 biases the backup member 250, seal element 240, and piston 220 back towards their initial positions as shown in FIG. 3. The biasing member 260 will move the backup member 250, seal element 240, and piston 220 back towards their initial positions as the force of the biasing member 260 exceeds the force applied to the piston 220 by the hydraulic pressure applied via the port 211 in the cylinder 210.

The packer or seal assembly 100 of FIGS. 3 and 4 provide a packer or seal that may be constructed in the field and/or onsite. The assembly 400 may reduce the cost for providing an annular packing element for a tubing string. Conventional packers or annular sealing elements must typically manufactured off site requiring a body to be connected to a tubular. As the packers need to be pre-manufactured, a service provider may need to keep a large amount of inventory on hand to ensure that a desired packing device is ready depending on the application needed. In some instances, a well service provide and/or well owner may not have the appropriate packer or annular sealing device on hand depending on the application possibly requiring the production and/or wellbore services to be suspended until an appropriate packer can be ordered and/or delivered to the wellbore. The packer assemblies of the present disclosure may be used with tubulars already on site and may reduce the amount of parts needed in inventory. Further, the packer assemblies of the present disclosure may be assembled, as need, on site reducing potential inventory as well as potentially reducing down time.

The packer of the present disclosure may be used in well treatment into a formation of a wellbore. The teaching of the present disclosure may be used in a variety of well operations. For example, the operations may involve, but are not limited to, using one or more treatment agents to treat a formation, the fluids resident in a formation, a wellbore, and/or equipment in a wellbore, such as production tubing. The treatment agents may be in the form of liquids, gases, solids, semi-solids, and mixtures thereof. Illustrate treatment agents includes, but are not limited to, fracturing fluids, acids, stream, water, brine, anti-corrosion agents, cement, permeability modifiers, drilling muds, emulsifies, demulsifiers, traces, flow improvers, and various other treatment agents as would be appreciated by one of ordinary skill in the art having the benefit of this disclosure. Illustrative well operations include, but are not limited to, hydraulic fracturing, stimulation, tracer injection, cleaning, acidizing, steam injection, water flooding, cementing, and various other operations as would be appreciated by one of ordinary skill in the art having the benefit of this disclosure.

Figure 5:
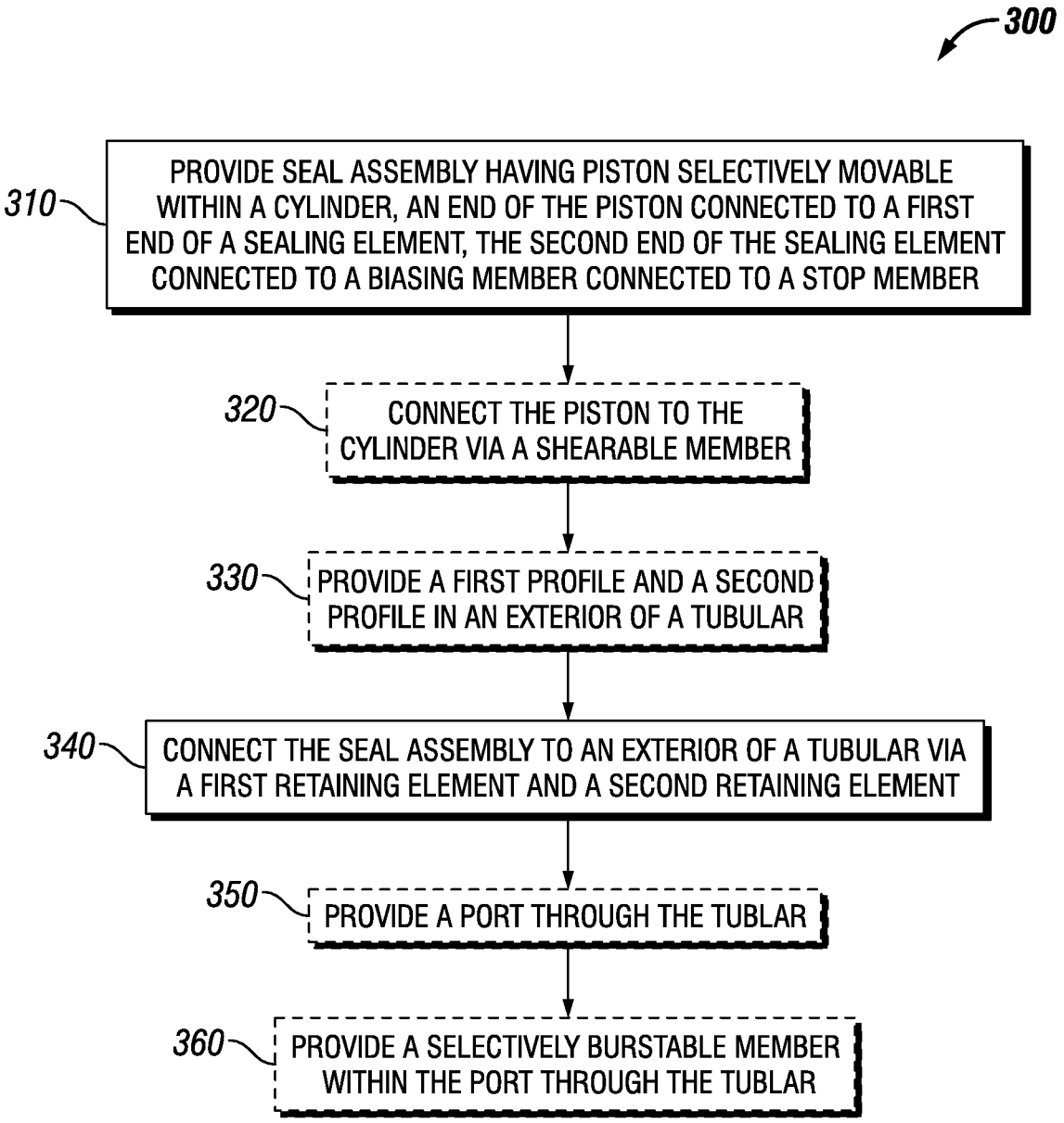
FIG. 5 shows a flow chart of an embodiment of a method of providing a slip-on hydraulic packer.

FIG. 5 is one embodiment of a method 300 of providing a slip-on hydraulic packer. The method 300 includes the step 310 of providing a packer or seal assembly that includes a piston selectively movable within a cylinder. An end of the piston is connected to a first end of a sealing element and the second end of the sealing element is connected to a biasing member, which is connected to a stop member. The second end of the sealing element may be connected to the biasing member via a backup member. Optionally, a portion of the piston may be connected to the cylinder via a shearable member in step 320.

The method may include optional step 330 of providing a first profile and a second profile in an exterior of a tubular. For example, first and second grooves may be turned into the exterior of a tubular. Various profiles may be provided on the exterior of the tubular for the engagement of first and second retaining elements to connect the packer assembly to the tubular as would be appreciated by one of ordinary skill in the art having the benefit of this disclosure. The method 300 includes connecting the seal assembly to an exterior of a tubular via a first retaining element and a second retaining element, in step 340. The method 300 may include providing a port through the tubular, at step 350. For example, a port may be drilled through a portion of the tubular. Alternatively, the packer assembly may be installed onto the exterior of a ported tubular. In another embodiment, the method 300 may include providing a port through a portion of the cylinder instead of through the tubular. The method 300 may also include the optional step 360 of providing a burstable member within the port of the tubular. The burstable member may alternatively be provided within a port through the cylinder if the piston is to be actuated by annular pressure as would be appreciated by one of ordinary skill in the art having the benefit of this disclosure.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A packer system comprising:

a tubular;

a packer assembly comprising a piston selectively moveable within a cylinder, a sealing element having a first end connected to an end of the piston and a second end, and a biasing member connected between a stop member and the piston;

a first retaining element that selectively connects the packer assembly to an exterior of the tubular; and a second retaining element that selectively connects the packer assembly to the exterior of the tubular, wherein a predetermined hydraulic pressure applied to the packer assembly moves the piston within the cylinder towards the stop member to move the sealing element from an unset position to a set position.

2. The packer system of claim 1, further comprising a backup member, the backup member connected between the second end of the piston and the biasing member.

3. The packer system of claim 1, wherein the predetermined hydraulic pressure is applied to the cylinder from an interior of the tubular through a port in the tubular.

4. The packer system of claim 3, wherein the piston is selectively connected to the cylinder by at least one shearable element and wherein the at least one shearable element is configured to shear and release the piston from the cylinder upon the application of the predetermined hydraulic pressure.

5. The packer system of claim 3, further comprising a burstable member positioned within the port in the tubular to selectively close the port in the tubular, wherein the burstable member is configured to burst upon the application of the predetermined hydraulic pressure to permit the predetermined hydraulic pressure to be applied to the piston positioned within the cylinder.

6. The packer system of claim 1, wherein at least one of the first retaining element or the second retaining element further comprises a snap ring positioned within a profile on the exterior of the tubular.

7. The packer system of claim 1, wherein at least one of the first retaining element or the second retaining element further comprises a set screw that engages a profile on the exterior of the tubular.

8. The packer system of claim 1, wherein the predetermined hydraulic pressure is applied to the cylinder from the exterior of the tubular through a port in the cylinder.

9. The packer system of claim 8, wherein the piston is selectively connected to the cylinder by at least one shearable element and wherein the at least one shearable element is configured to shear and release the piston from the cylinder upon the application of the predetermined hydraulic pressure.

10. The packer system of claim 8, further comprising a burstable member positioned within the port in the cylinder to selectively close the port in the cylinder, wherein the burstable member is configured to burst upon the application of the predetermined hydraulic pressure to permit the predetermined hydraulic pressure to be applied to the piston within the cylinder.

11. A method of providing a slip-on hydraulic packer comprising:

providing a seal assembly, the assembly comprising a piston selectively movable within a cylinder, an end of the piston being connected to a first end of a sealing element, a second end of the sealing element being connected to a biasing member connected to a stop member;

connecting the seal assembly to an exterior of a tubular with a first retaining element; and connecting the seal assembly to the exterior of the tubular with a second retaining element.

12. The method of claim 11, further comprising providing a first profile on the exterior of the tubular and providing a second profile on the exterior of the tubular, wherein the first retaining element engages the first profile and wherein the second retaining element engages the second profile.

13. The method of claim 11, further comprising connecting a portion of the piston to a portion of the cylinder via a shearable member configured to shear under a predetermined amount of hydraulic pressure.

14. The method of claim 11, further comprising providing a port through the tubular, wherein hydraulic pressure from an interior of the tubular may be applied to the piston within the cylinder.

15. The method of claim 14, further comprising providing a burstable element within the port through the tubular configured to burst under a predetermined amount of hydraulic pressure, wherein the burstable element prevents fluid flow through the port until the burstable element bursts.

16. The method of claim 14, further comprising pumping fluid down a tubing string to the interior of the tubular, hydraulic pressure from the interior of the tubular moving the piston towards the stop member, the movement of the piston moving the sealing element from an unset position to a set position.

17. The method of claim 11, further comprising providing a port through the cylinder, wherein hydraulic pressure from the exterior of the tubular may be applied to the piston within the cylinder.

18. The method of claim 17, further comprising pumping fluid down an annulus between a tubing string and a wellbore, hydraulic pressure from the annulus moving the piston towards the stop member, the movement of the piston moving the sealing element from an unset position to a set position.

19. The method of claim 18, further comprising providing a burstable element within the port through the cylinder configured to burst under a predetermined amount of hydraulic pressure, wherein the burstable element prevents fluid flow through the port until the burstable element bursts.

20. A slip-on hydraulic packer kit comprising:

a piston positioned within a cylinder, wherein the piston is movable within the piston upon an application of a predetermined amount of hydraulic pressure within the cylinder;

a sealing element having a first end and a second end, the first end being connected to an end of the piston;

a backup member connected to the second end of the sealing element;

a stop member;

a biasing member connected between the backup member and the stop member, a first retaining member; and a second retaining member, wherein the first and second retaining members are configured to selectively connect the slip-on hydraulic packer kit to a tubular and wherein the application of the predetermined amount of hydraulic pressure within the cylinder moves the piston towards the stop member to move the sealing element from an unset position to a set position.

21. The slip-on hydraulic packer kit of claim 20, wherein the predetermined amount of hydraulic pressure is applied to the cylinder from an interior of the tubular through a port in the tubular.

22. The slip-on hydraulic packer kit of claim 20, wherein the predetermined amount of hydraulic pressure is applied to the cylinder from an exterior of the tubular through a port in the cylinder.

23. The slip-on hydraulic packer kit of 20, further comprising at least one of a shearable member configured to shear upon application of the predetermined amount of hydraulic pressure or a burstable member configured to burst upon application of the predetermined amount of hydraulic pressure.

24. A method of treating a borehole comprising:

attaching to a tubular a hydraulically actuated packer system having one or more retaining elements for selectively connecting the packer system to an exterior surface of the tubular, the packer system comprising a piston selectively moveable within a cylinder, a sealing element having a first end connected to an end of the piston and a second end connected to a backup member, and a biasing member connected between a stop member and the backup member;

applying a predetermined hydraulic pressure to the piston within the cylinder to move the sealing element from an unset position to a set position by advancing the piston towards the stop member; and wherein a first zone of the borehole is isolated from a second zone.

25. The method of claim 24, further comprising performing a well treatment in the first or second zones of the borehole.

26. The method of claim 25, wherein performing the well treatment further comprises at least one of hydraulic fracturing, stimulation, tracer injection, acidizing, steam injection, water flooding, and cementing.

* * * * *